US005515837A

United States Patent [19]

Nin et al.

[11] Patent Number: 5,515,837

[45] Date of Patent: May 14, 1996

[54] SAFETY NOZZLE FOR MULTI-SHOT PROJECTILE SHOOTING AIR GUN

[75] Inventors: Ku I. Nin, Andar, Macau; Bruce M. D'Andrade, Readington Township, Hunterdon County, N.J.

[73] Assignee: Larami Corporation, Mount Laurel, N.J.

[21] Appl. No.: 262,154

[22] Filed: Jun. 20, 1994

[51] Int. Cl.[6] ..... F41B 11/26; F41B 41/32

[52] U.S. Cl. ..... 124/59; 124/69; 124/73

[58] Field of Search ..... 124/56, 59, 69–74, 124/76

[56] References Cited

U.S. PATENT DOCUMENTS

| | | | |
|---|---|---|---|
| 1,488,995 | 4/1924 | McCollom . | |
| 1,575,644 | 3/1926 | Schmidt | 124/66 |
| 2,011,749 | 8/1935 | Brading . | |
| 2,237,678 | 4/1941 | Lohr et al. . | |
| 2,818,056 | 12/1957 | Martin . | |
| 2,980,096 | 4/1961 | Merz | 124/74 |
| 4,422,433 | 12/1983 | Milliman | 124/74 |
| 4,732,136 | 3/1988 | Ferri | 124/67 |
| 4,735,239 | 4/1988 | Salmon et al. | 141/25 |
| 4,854,480 | 8/1989 | Shindo | 222/79 |
| 4,892,081 | 1/1990 | Moormann | 124/65 |
| 5,373,832 | 12/1994 | D'Andrade | 124/69 |

FOREIGN PATENT DOCUMENTS

| | | | |
|---|---|---|---|
| 551863 | 10/1958 | Italy | 124/72 |

*Primary Examiner*—John A. Ricci
*Attorney, Agent, or Firm*—Kenneth P. Glynn

[57] ABSTRACT

The present invention relates to a safety mechanism for multi-shot air guns having a main housing, a barrel, a launch port located at the barrel of the main housing and adapted for air pressure connection to an aligned nozzle and having a pressurization mechanism and a release for releasing pressure from the launch port to an aligned nozzle and having a multi-shot projectile magazine capable of having one nozzle aligned with the launch port and being advanceable to provide sequential alignments of nozzles for firings of a plurality of projectiles. Each nozzle includes an impediment member contained therein. The safety mechanism includes one or more valves connected to either the launch port or each of the nozzles, to prevent flow of pressurized air into the nozzles when closed and to allow flow of pressurized air when opened; a biasing device for biasing the valve to a closed position; an opening device movably located within the nozzle. This has a first position when a projectile is not located in the nozzle, corresponding to the valve being closed, and has a second position when a projectile is located in the nozzle and fitted to the impediment member, corresponding to the valve being opened.

20 Claims, 3 Drawing Sheets

SAFETY NOZZLE FOR MULTI-SHOT PROJECTILE SHOOTING AIR GUN

BACKGROUND OF THE INVENTION

1. Field of the Invention

The present invention is directed to air pressurized, multi-shot toy guns for launching projectiles from a plurality of nozzles with launch tubes in a multi-shot projectile magazine attached thereto. More specifically, the present invention relates to a safety mechanism for nozzles of such air pressurized toy guns to reduce the chances of dangerous objects being shot therefrom while automatically permitting the shooting of mating projectiles, e.g. soft darts, therefrom.

2. Information Disclosure Statement

Air guns have been available for decades and typically rely upon a reciprocal hand pump to compress air in a chamber for subsequent firing. These are often used for firing BB's or pellets. Other gas powered guns rely upon canisters of compressed gas wherein the gas is released for firing. Toy guns which involve the use of bladders have been developed for storing and shooting water.

The following patents are representative of toy guns, illustrating in chronological order toy guns which shoot projectiles and/or are otherwise pressurized:

U.S. Pat. No. 1,488,995 issued to Edwin McCollom describes a projectile shooting toy gun which relies upon a spring loaded, u-shaped rod which is cocked by pulling and released by a trigger release.

U.S. Pat. No. 2,011,749 to Harry Brading describes a dart game which uses a blow pipe for launching the darts.

U.S. Pat. No. 1,575,644 to William Schmidt describes a pistol which fires a projectile and relies upon a compression spring to compress air and to thereby actuate the firing of the projectile.

U.S. Pat. No. 2,237,678 issued to Raymond Lohr et al describes a repeating, cork shooting toy which utilizes a cork magazine which rotates after each firing to position the next cork in sequence for firing.

U.S. Pat. No. 2,818,056 to Robert Martin describes a compressed gas-operated propelling mechanism in a toy gun.

U.S. Pat. No. 4,732,136 issued to Giampiero Ferri sets forth a toy gun which relies upon spring based compression to a launch a plastic bullet or the like.

U.S. Pat. No. 4,735,239 issued to Michael Salmon et al describes a liquid projecting device which is basically a bladder and a release trigger, the bladder being expanded by being filled up with water. Likewise, U.S. Pat. No. 4,854,480 issue to Robert Shindo describes a water gun with an expandable rubber tube or bladder which is filled with water and subsequently released by the trigger mechanism.

U.S. Pat. No. 4,892,081 Randall Moormann sets forth a compressible ball launcher which relies upon a telescoping cylindrical gun to compress air to force a ball out of a nozzle.

Notwithstanding the foregoing, the prior art neither teaches nor suggests the use of a safety mechanism for pressurized air toy gun nozzles to reduce the possibility of shooting hostile or dangerous projectiles therefrom, as in the present invention.

SUMMARY OF THE INVENTION

The present invention relates to a safety mechanism for multi-shot air guns having a main housing, a barrel, a launch port located at the barrel of the main housing and adapted for air pressure connection to an aligned nozzle and having a pressurization mechanism and a release for releasing pressure from the launch port to an aligned nozzle and having a multi-shot projectile magazine capable of having one nozzle aligned with the launch port and being advanceable to provide sequential alignments of nozzles for firings of a plurality of projectiles. Each nozzle includes an impediment member contained therein. The safety mechanism includes one or more valves connected to either the launch port or each of the nozzles, to prevent flow of pressurized air into the nozzles when closed and to allow flow of pressurized air when opened; a biasing device for biasing the valve to a closed position; an opening device movably located within the nozzle. This has a first position when a projectile is not located in the nozzle, corresponding to the valve being closed, and has a second position when a projectile is located in the nozzle and fitted to the impediment member, corresponding to the valve being opened.

BRIEF DESCRIPTION OF THE DRAWINGS

The present invention is more fully understood when the present specification is taken in conjunction with the drawings appended hereto, wherein.

DETAILED DESCRIPTION OF THE PRESENT INVENTION

The present invention toy air gun safety nozzle has been developed to provide high powered, safe shooting of projectiles, such as foam darts. The toy air gun utilizing the safety mechanism of the present invention may be one which is pre-pressurized, e.g. via pump, with a tank or with a bladder, or may be a pre-loaded, cocking gun with a pressure creating spring-fired piston. In fact, it may be any known or yet to be developed air gun for shooting projectiles through a nozzle.

Figure 1:
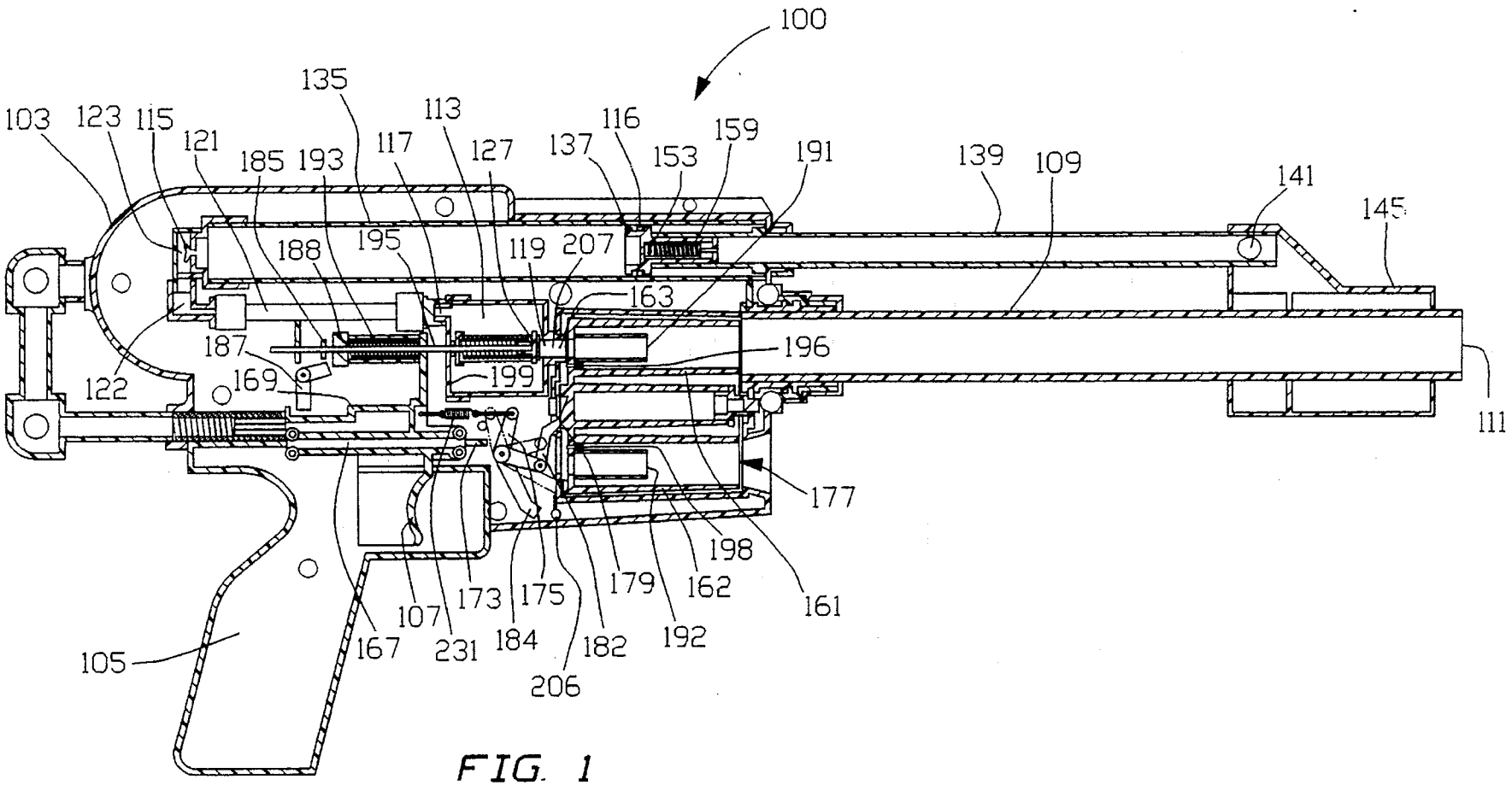
FIG. 1 shows a side cut view of a present invention safety mechanism within a pump-tank multi-shot air gun.

Referring now to FIG. 1, there is a present invention safety mechanism-containing toy air gun 100 which has an automatically advancing magazine for sequential multiple shots. FIG. 1 shows a side view of the toy air gun 100 with main housing 103, handle 105, trigger 107 and barrel 109 with opening 111.

Pressurizable tank 113 is located within housing 103. Tank 113 has inlet 117 and outlet 119 and is cylindrical, but could be of another shape and not exceed the scope of the present invention. Inlet 117 is connected to tube connector 121 which is connected to tube sections 122 and 123. Inlet tube section 123 has a one way check valve 115 to prevent pressurized air from exiting therethrough.

Toy air gun 100 is operated by pressurizing the pressurizable tank 113 with air. Air is forced into the pressurizable tank 113 by the relative movement of the piston 137 within the air pump shaft 135. The piston 137 is operated by the pump rod 139 that connects the piston 137 to the slider handle 145. The pump rod 139 is anchored to the slider handle 145 via formed connector 141. The slider handle 145 is operated manually by the user. The user holds the slider handle 145 with one hand and the gun handle 105 with the other. The slider handle 145 is then moved back and forth along the length of the barrel 109. The back and forth action is transferred to the piston 137, which forces air past a one way O-ring valve 116, when pulled out, and then, when pushed in forces the air past valve 115 through a length of tubing and into the pressurizable tank 113. Air is continuously added to the tank 113 via inlet 117 until a desired pressure is reached.

Once under pressure, the air in tank 113 is prevented from flowing freely through the outlet 119 by valve 127. Safety release valve 153, with spring 159, prevents over pressurization. The strength of spring 159 in its biased configuration is calibrated, so that when the pressure of air within the gun reaches a predetermined maximum value, the spring 159 will allow valve 153 to be released until safe pressure is maintained.

Figure 2:
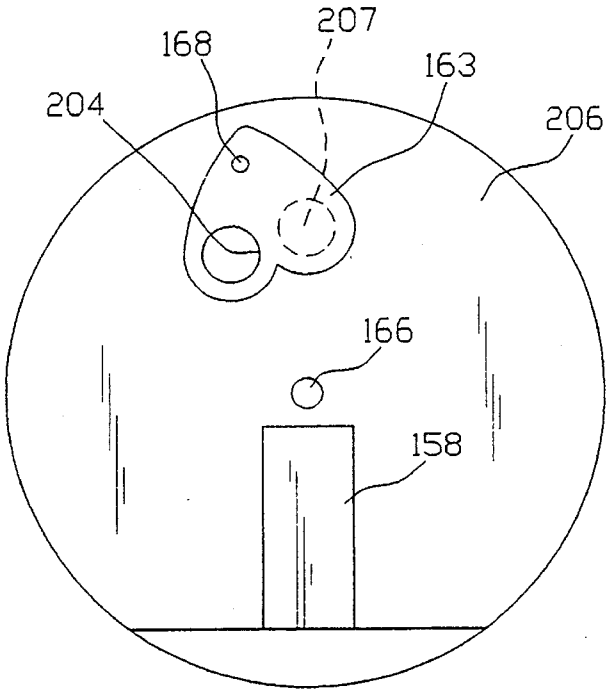
FIG. 2 shows a front view of a component of the mechanism shown in FIG. 1.

A projectile, e.g. a soft foam dart is adapted to fit into launch tube 161. Note that post 207 acts as a launch post and has a hinged valve 163 located at its forward end for controlling air flow to prevent or permit launching. Referring to both FIGS. 1 and 2, and especially now FIG. 2, housing wall 206, shown in its front view, includes launch post 207 being covered by closed valve 163. Valve 163 has a spring hinge 168 and has an orifice 204 located therein. In its first position, i.e. its closed position, valve 163 closes off post 207 from the launch nozzles such as nozzle 161 and 162. It also has a second position which is an open position, such that its orifice 204 is in direct alignment with post 207 to permit air flow to the nozzles. Spring loaded pins 196 and 198, for example, act as opening means. When a hollow dart, for example, is inserted into nozzle 161 and over launch tube 191, this causes pin 196 to push out towards wall 206 and when magazine 177 is rotated the extended pin will move valve 163 from its first (closed) position to its second (open) position to permit shooting. A side view of this can be seen in FIG. 3, discussed below. Also shown in FIG. 2 is magazine axle hole 166 and pawl slot 158 for advancing pawl 182 (shown in. FIG. 1).

Launch nozzle 161 is a formed part of rotating magazine 177, which is mounted on housing 103 at its forward end and is connected to and aligned with barrel 109. This magazine 177 has multi-shot capability and has, in this case, six launch nozzles exemplified by nozzles 161 and 162 and six impediment members, here launch tubes such as launch tubes 191 and 192. Magazine 177 and toy gun 100 generally, operate as follows:

After a user has loaded projectiles onto the magazine 177 and has pressurized tank 113, trigger 107 is actuated. As trigger 107 moves to the left (i.e., is pulled), trigger bar 167 and trigger riser 199 likewise move accordingly and trigger catch 169, moves pawl 187 clockwise. Rod 195, spring 193, hammer 188 and hammer receiver 185 operate in communication therewith, as shown. This causes hammer 188 to strike rod 195 to overcome Spring 193 to open and close valve 127 with a burst of air pressure which travels down tube 163 and down launch tube 161 to fire projectile 191.

Referencing again the same initial mechanism, i.e. the pull of trigger 107, when trigger bar 167 moves to the left, push plate 173 of bar 167 releases revolver advance 175, pulled by spring 231 so as to catch on magazine detent 179 via advancing pawl 182, and also locking the magazine into the next position via bar lock 184. Thus, the gun 100 is operated by trigger 107 so as to advance the next launch tube on the rotating magazine, lock it in and fire it.

Figure 3:
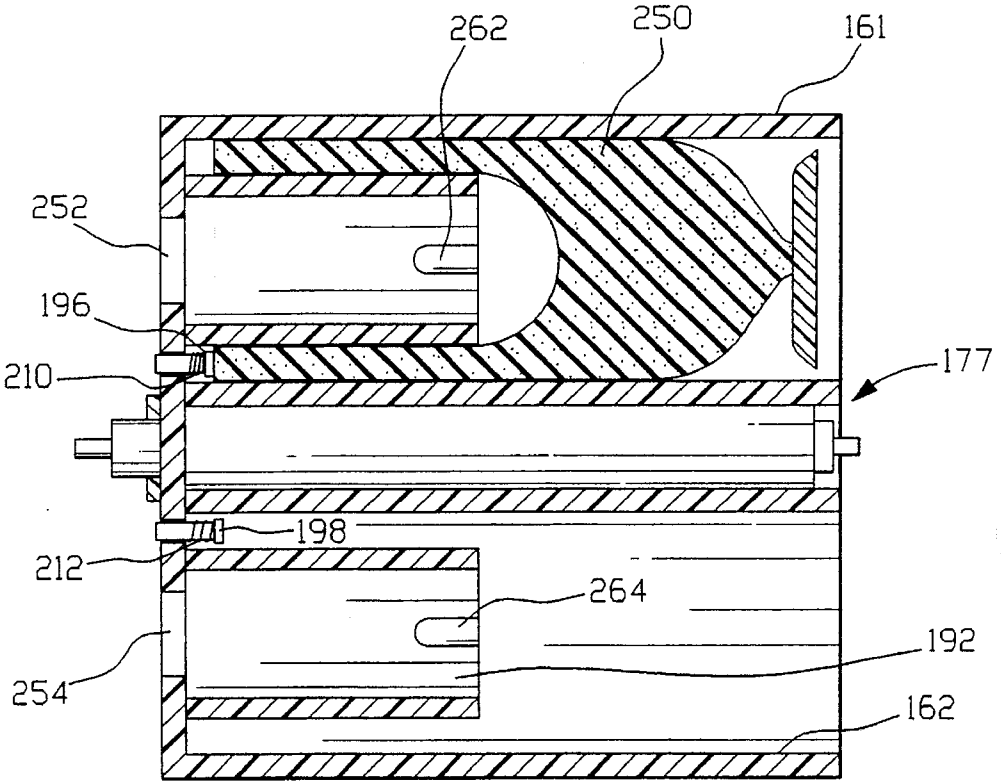
FIG. 3 shows a side view of the magazine component of the gun shown in FIG. 1.

It can be seen from FIG. 3 a side cut view of magazine 177 that nozzles 161 and 162 have air inlets 252 and 254. Note that with one dart loaded, that pins 196 and 198 with springs 210 and 212, have a first position (rest position) as shown for pin 198, when unloaded, and a second position (activated position) when properly loaded, so as to be able to open valve 163 when rotated to the firing position, as shown for pin 196 with loaded soft dart 250.

The above FIGS. 1 through 3 illustrate an embodiment wherein the valve is located on the launch post. Alternatively, there could be a plurality of such valves, one for each of, and located on, the magazine nozzles. The operations of these embodiments may generally be characterized as follows:

The valve is located on the launch port, when the opening device is moved from its first position to its second position, i.e. when a properly mating projectile is inserted, and the nozzle is then aligned with the launch port, the valve is moved from its closed position to its open position to permit the shooting of a projectile. When valves are located on each of the nozzles, then, when the opening device is moved from its first position to its second position, i.e. when a properly mating projectile is inserted, the valve will be moved from its closed position to its open position for subsequent firing even before it is rotated to align with the launch post. The following Figures show a nozzle for incorporation into a magazine wherein each nozzle has its own valve.

Figure 4:
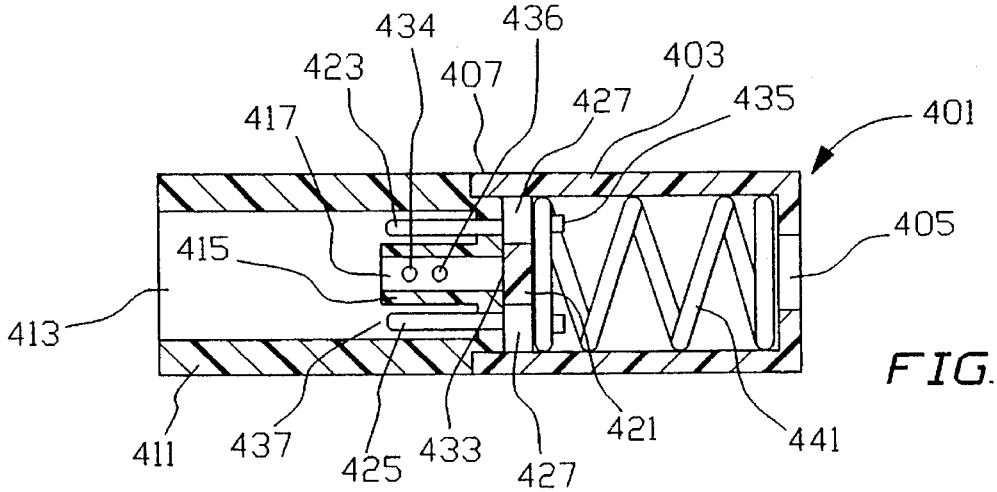
FIG. 4 shows an alternative safety mechanism of the present invention.

FIG. 4 shows a present invention safety mechanism 401 which includes a nozzle formed of two portions, namely, a front portion 411 and a rear portion 405, as shown. There is an inlet 405 and an outlet 407, fitting 409, launch tube 415, launch tube hollow inside 417, and launch tube inlet 433. Launch tube 415 and nozzle front portion 411 form annular space 437, enabling a hollow projectile (not shown, see FIG. 5) below to be fitted thereon.

There is a valve 421 which has a first, closed position, as shown, and held by being biased by spring 441, held in place by legs such as leg 435. It also has a second, open position when valve 421 is moved to the right, via opening mechanisms 423 and 425 located within annular space 437, which are directly connected to valve 421, as shown.

Figure 5:
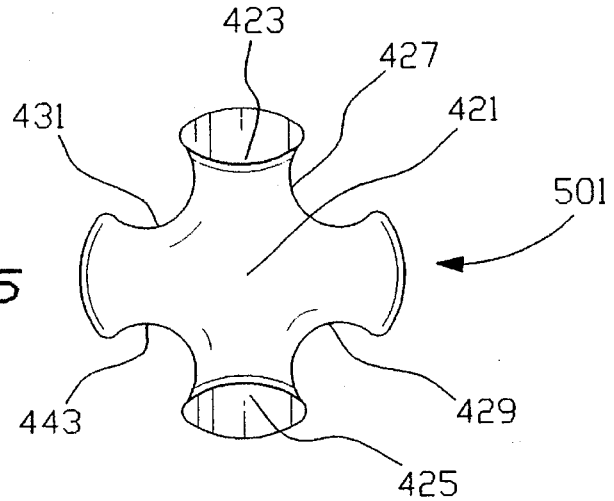
FIG. 5 shows a front view of a component of the safety mechanism shown in FIG. 3; and, FIG. 6 shows the safety mechanism of FIG. 4 but in the loaded position.

FIG. 5 shows opening mechanism 423 and 425 in a top view as valve and opening device 201. Device 201 includes air passage openings 427, 429, 431 and 443, valve 421 and mechanisms 423 and 425. As can be seen, either opening mechanism 423 or 425, or both may be and in most cases both will be pushed downwardly along with valve 421 against spring 441 when a hollow projectile is inserted into annular space 437, thereby opening valve 421 and allowing shooting, pressurized air to enter launch tube inlet 433. Thus, when the opening mechanisms are in their first, rest position, valve 421 closes inlet 433 and the base of front portion 411 shuts off air passage openings 427, 429, 431 and 443. They open when the opening mechanisms are pushed to the right to a second position when spring 441 is compressed. Also, launch tube 415 includes an optional, second, independent safety arrangement. There are air exit ports 434 and 436 which cause air to escape laterally when the opening mechanisms are pushed to the right, but the launch tube is not fully fitted by a hollow projectile.

Figure 6:
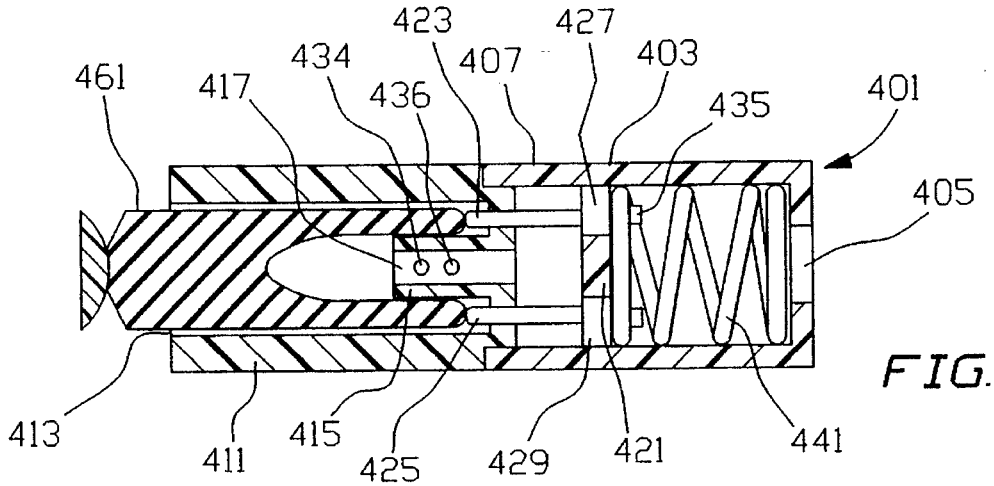

FIG. 6 shows safety mechanism 401 of FIG. 4 in its ready to fire mode. Here, soft dart hollow projectile 461 has been inserted and is fitted over launch tube 415. Air exit ports 434 and 436 are sealed by the projectile 461, opening mechanisms 423 and 425 have been pushed to the right to open valve 421 and air passages such as passages 427 and 429 and, when fitted onto a gun via fitting 409, when the gun is fired, i.e. pressurized air released, the projectile 461 will be shot therefrom.

The safety mechanisms of the present invention will thus prevent or inhibit undersizable shootings of marbles, hard rubber darts from older dart guns, plastic bullets, etc.

Obviously, numerous modifications and variations of the present invention are possible in light of the above teachings. For example, the impediment member may be a side plate projecting from the inside wall of the nozzle with a mating-cut projectile. Alternatively, it could be a solid center post, center plate, protruding wall peg, or other protrusion with a corresponding formed or cut projectile. It is therefore understood that within the scope of the appended claims, the invention may be practiced otherwise than as specifically described herein.

What is claimed is:

1. In a multi-shot air gun having a main housing, a barrel, a launch port located at the barrel of said main housing and adapted for air pressure connection to an aligned nozzle, and having a pressurization means and means for releasing pressure from said launch port to an aligned nozzle, and having a multi-shot projectile magazine attached to said barrel and having a plurality of nozzles with impediment members therein, each adapted for receiving and shooting a projectile, said magazine capable of having one nozzle aligned with said launch port and being advanceable to provide sequential alignments of nozzles for firings of a plurality of projectiles, each of said nozzles having an inlet and an outlet, the improvement which comprises:

including within each of said plurality of nozzles at each nozzle inlet, a safety mechanism for reducing opportunities for release of pressure when a projectile is not fitted in said nozzle, said safety mechanism including:

(a) a valve connected to one of (i) said launch port and (ii) each of said plurality of nozzles, to prevent flow of pressurized air into an aligned nozzle when said valve is in a closed position and to allow flow of pressurized air into said aligned nozzle when said valve is in an opened position;

(b) a biasing means biasing said valve to a closed position;

(c) an opening means movably located within said nozzle, and being operably connected to said valve, and having a first position when a projectile is not located in said nozzle, said first position corresponding to said valve being closed, and having a second position when a mating projectile is located in said nozzle, said second position corresponding to said valve being opened, wherein when said opening means is moved from its first position to its second position, and at least when said aligned nozzle is moved into alignment, said valve is positioned in its open position.

2. The safety mechanism of claim 1 wherein said impediment is a launch tube and said launch tube has a predetermined length which is less than the predetermined length of each of said nozzles.

3. The safety mechanism of claim 2 wherein said biasing means is a spring.

4. The safety mechanism of claim 2 wherein said nozzle and said launch tube establish an annular space therebetween and said opening means is at least one protrusion extending from said valve to said annular space.

5. The safety mechanism of claim 4 wherein said biasing means is a spring.

6. The safety mechanism of claim 4 wherein said nozzle and said launch tube are unistructurally formed.

7. The safety mechanism of claim 4 wherein said nozzle and said launch tube are connected to one another by an annular base having at least one orifice therethrough.

8. The safety mechanism of claim 7 wherein said valve is located on said launch port and wherein said nozzle and said launch tube are connected to one another by an annular base having at least one orifice therethrough and wherein said opening means is a spring biased pin extending through said orifice.

9. The safety mechanism of claim 2 wherein said nozzle and said launch tube are unistructurally formed.

10. The safety mechanism of claim 2 wherein said nozzle and said launch tube are connected to one another by an annular base having at least one orifice therethrough.

11. The safety mechanism of claim 10 wherein said valve is located on said launch port and wherein said nozzle and said launch tube are connected to one another by an annular base having at least one orifice therethrough and wherein said opening means is a spring biased pin extending through said orifice.

12. The safety mechanism of claim 2 wherein said opening means includes a hinged lever within said nozzle and connected to said valve.

13. The safety mechanism of claim 2 wherein said launch tube has a cylindrical wall with at least one portion thereof being removed to create a secondary air escape route as a safety feature separate from and in addition to said safety mechanism.

14. The safety mechanism of claim 1 wherein said biasing means is a spring.

15. The safety mechanism of claim 1 wherein said opening means is at least one protrusion extending from said nozzle to said valve.

16. The safety mechanism of claim 15 where in said biasing means is a spring.

17. The safety mechanism of claim 15 wherein said nozzle and said launch tube are unistructurally formed.

18. The safety mechanism of claim 1 wherein said nozzle and said launch tube are unistructurally formed.

19. The safety mechanism of claim 1 wherein said opening means includes a hinged lever within said nozzle and connected to said valve.

20. The safety mechanism of claim 1 wherein said launch tube has a cylindrical wall with at least on portion thereof being removed to create a secondary air escape route as a safety feature separate from and in addition to said safety mechanism.

* * * * *